United States Patent [19]

Pace

[11] 4,154,040

[45] May 15, 1979

[54] BUILDING SIDING AND BEVELED BACKER PANEL ASSEMBLY AND METHOD

[76] Inventor: Thomas G. Pace, Box 74, Bagley, Wis. 53801

[21] Appl. No.: 880,763

[22] Filed: Feb. 24, 1978

[51] Int. Cl.[2] ..... E04D 1/00; E04B 2/08

[52] U.S. Cl. ..... 52/521; 52/531

[58] Field of Search ..... 52/521, 531, 311, 316, 52/520; 156/71

[56] References Cited

U.S. PATENT DOCUMENTS

| | | | |
|---|---|---|---|
| 3,159,943 | 12/1964 | Sugar et al. | 52/531 X |
| 3,284,967 | 11/1966 | Elliott et al. | 52/521 X |
| 3,420,024 | 1/1969 | Salvo | 52/521 X |
| 3,458,962 | 8/1969 | Kendall | 52/531 X |
| 3,504,467 | 4/1970 | Hatch et al. | 52/521 X |
| 3,552,078 | 1/1971 | Mattes | 52/531 X |
| 3,703,795 | 11/1972 | Mattes | 52/521 |
| 3,998,021 | 12/1976 | Lewis | 52/531 |
| 4,033,802 | 7/1977 | Culpepper et al. | 52/531 X |

*Primary Examiner*—J. Karl Bell

*Attorney, Agent, or Firm*—Zarley, McKee, Thomte, Voorhees & Sease

[57] ABSTRACT

A building siding panel in combination with a backer board panel which has a top beveled edge and an identically beveled bottom edge. The result of employment of a beveled edge backer board insulating panel is easier installation; the backer board panel provides complete support for the rear facing surface of the building siding along its entire rearward face; the insulating effect is superior; and lessening of installation costs since time of assembly is significantly decreased.

9 Claims, 4 Drawing Figures

BUILDING SIDING AND BEVELED BACKER PANEL ASSEMBLY AND METHOD

BACKGROUND OF THE INVENTION

The use of building panels as an exterior siding covering for buildings is well known. It has been done for many years. However, one of the problems associated with such panels is difficulty of installation. Typical panels such as aluminum siding panels need an insulative backer board panel which is inserted at the time of installation. The backing panel serves two primary purposes; in the first instance it provides support for the siding covering, and in the second instance, it provides an insulative factor in order to prevent heat transfer from the interior of the building outwardly to the exterior.

The installation of backerboard panels is difficult and time consuming. In the typical operation, the backerboard panel is inserted against the rearward face of a longitudinally extending siding cover, and then attached to the exterior surface of the building by means of nails or the like. The second course of paneling is then hooked to marginal interlocking members along the upper margin of the first panel, and a second backerboard is then shoved downwardly into the space behind the second course of siding paneling. In so doing, it is possible for the second backerboard panel, at it lowermost edge to be "hung up" on the top longitudinally extending surface of the first backerboard panel. This makes installation slow, difficult and time consuming. In addition, the natural tendency is to forget about this dilemma and just leave the panels in the "hung up" position. The result is lack of complete support along the rear face of the siding covering, and poor insulative effect.

Accordingly, one object of this invention is to provide an insulative backerboard which provides for easier installation of the backerboard.

Another object of this invention is to provide a backerboard panel which will not hang up during installation.

Yet another object of this invention is to provide a backerboard which can easily be installed to provide a complete backing surface to the rear extending face of the siding covering.

Yet another object of this invention is to provide a method of installing siding covering which employs the beveled backerboards of this invention, which allows for easy, quick and effective installation.

SUMMARY OF THE INVENTION

Figure 4:
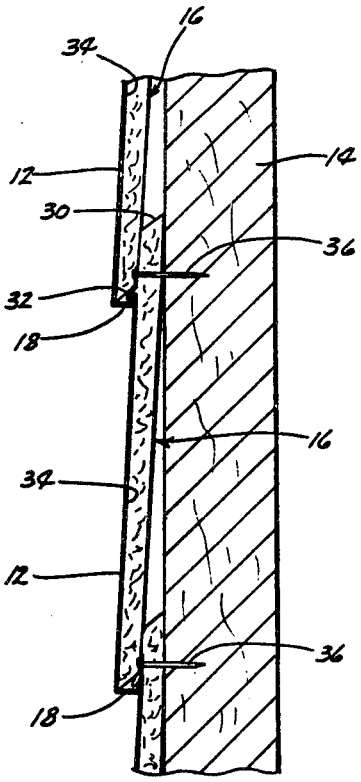
FIG. 4 is an enlarged vertical section along line 4—4 of FIG. 3 illustrating the position of the completely assembled unit on the exterior surface of a building.

A building siding and beveled backer panel assembly and a method of installation which provides for quick, easy installation. Traditional backerboards have a rectangular vertical cross-section. The result is that during installation the longitudinally extending top flat surface of a lower backerboard panel has a tendency to hang up with the longitudinally extending bottom flat surface of the next higher course of backerboard panel. As a result, the desired overlapping is often not achieved, backing support is not provided, and a lower insulative value is achieved. In accordance with the present invention, the backerboard panel has a vertical cross section in the shape of a parallelogram, with the longitudinally extending upper and lower surfaces being identically beveled. Thus, when a second course of backer board panel is inserted in the assembly, the lowermost surface thereof hits the beveled upper surface of the next lower panel, and because of the beveled edge, slides by it down into its proper overlapping relationship as shown in FIG. 4.

DETAILED DESCRIPTION OF THE INVENTION

Referring to the drawings, numeral 10 designates a building having the new siding 12 installed. The siding is secured to a suitable exterior framework of the building such as conventional studs 14.

Figure 1:
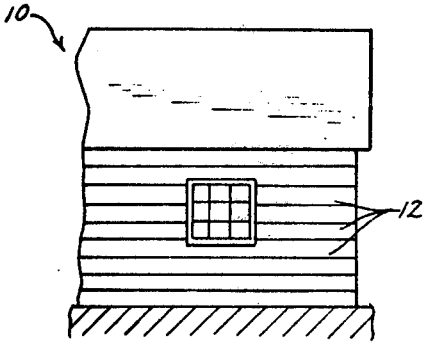
FIG. 1 is an elevational view of a building employing the siding of this invention.
Figure 2:
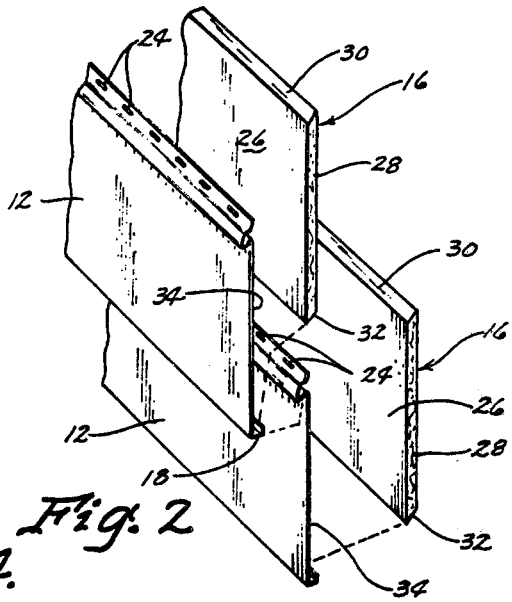
FIG. 2 is an enlarged fragmentary end view showing how the siding and backerboard of this invention are assembled.

The individual siding panels 12 and the beveled edge backerboards 16 are best shown in FIG. 2. Each siding panel 12 has a longitudinally extending rearward flange 18 extending along its entire bottom edge. On the upper margin of each panel 12 is a longitudinally extending interlock ridge 20. Just above the ridge 20 on the upper most part of each panel 12 is a fastening margin 22 having a plurality of spaced apart apertures 24 which are, of course, used for nailing the siding to studs 14.

Backerboard panel 16 has a forwardly extending face 26, a longitudinally extending top beveled edge 30, and a longitudinally extending bottom beveled edge 32, with top edge 30 and bottom edge 32 having identical bevels so that they are spaced apart parallel relationship with respect to each other.

The backerboard panel 16 may be comprised of a variety of insulative materials, but is typically made of a polystyrene material, although it should be understood that it may be comprised of other materials, such as fiber board or the like. The thickness of backerboard 16 may vary. Normally backerboard panels are $\frac{3}{8}$ of an inch thick. One of the advantages of this invention is that a thicker than normal polystyrene backerboard, for example, $\frac{5}{8}$ inch, may be employed with the result being a greater insulative effect.

Figure 3:
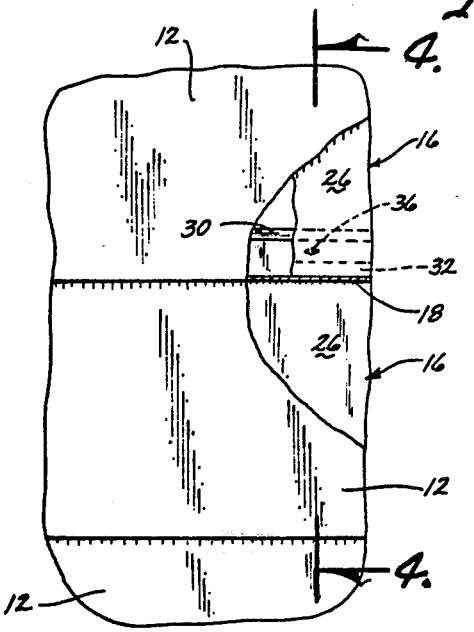
FIG. 3 is an enlarged frontal view, with certain parts broken away of the siding of this invention.

As depicted in FIGS. 2 and 3, the backer board panel 16 is installed so that its face 26 is in abutting relationship with rearwardly extending face 34 of siding panel 12. The backerboard panel is installed so that the lower bevel 32 has its bevel extending inwardly towards rear face 34 of panel 12 and its upper bevel 30 extending up and away from rear face 34 of panel 12. As a result, when a second backerboard panel is installed in a second course of paneling, the bottom edge 32 of the second course panel hits edge 30 of the first panel as it is being installed, slides downwardly over that edge, and into its proper overlapping position as depicted in FIG. 4, with ease. Thus, the result of a hang-up between two flat surfaces where conventional rectangular cross-sectional backerboards are employed is avoided.

The manner of assembly of the units of this invention is as follows: The backerboard panel 16 is inserted, in the manner previously described in the rearward flange 18 of a sliding panel 12. Assuming this to be the lowermost course of siding, it is then attached via nails 36 to stud 14. The next higher course of siding panel 12 is then installed in the following manner. The rearward flange 18 of the second course of panel 12 is then hooked into interlocking member 20 of the first panel. The second course of the backerboard is then inserted, in the manner previously described with reference to the first panel. It does not hang up because as bottom edge 32 of the second course backer panel meets top beveled edge 30 of the first panel, it slides across that and downwardly into the space in rearward flange 18 of the second panel, into its proper overlapping relationship. Thus, the rearward face 34 of the siding panel 12 and the forward face 26 of the backerboard panel 16 are in continuous abutting relationship providing complete support and maximum insulative effectiveness. In employing this manner of assembly, it has been found desirable at times to insert the second course backer panel 16 in a slightly offset manner into the rearward flange 18 of the second course backer panel and thereafter laterally slide it as it is being forced down into the bottom portion of rearward flange 18. In this manner, installation is even quicker.

It can therefore be seen that the invention accomplishes at least all of its stated objects.

What is claimed is:

1. A plurality of elongated siding panels extending in horizontal courses, each panel having a longitudinal extending rearward flange and a longitudinally extending interlock member on the upper margin thereof, adapted for interlocking the rearward flange of one panel with the upper margin interlock member of the next lower course panel, and in abutting face to face relationship immediately behind each siding panel, an elongated backerboard having forward and rearward surfaces and beveled top and bottom edges, each said beveled edge extending downwardly from said rearward surfaces to said forward surface, said bottom beveled edge fitting within the rearward flange of one of said siding panels and having sliding capability over the top beveled edge of the next lower course of backerboard panel.

2. The combination of claim 1 wherein the rear extending face of each siding panel and the forward extending face of each backerboard panel are in substantially continuous contacting relationship along their complete width to provide uniform back support for the entire width of said backer panel.

3. The combination of claim 1 wherein the backerboard panel is a polystyrene backerboard.

4. The combination of claim 3 wherein the backerboard panel is about $\frac{3}{8}$ of an inch thick to about $\frac{5}{8}$ inch thick.

5. The method of erecting a building siding panel system having beveled backerboard panels associated with each siding panel, said method comprising obtaining a first elongated siding panel, said panel having a longitudinal rearward flange and a longitudinal interlock member on the upper margin of said panel adopted for interlocking the rearward flange of said panel with the upper margin interlock member of another panel, and inserting in the bottom flange of said first siding panel a longitudinally extending beveled edge of a first backerboard panel so that the forward face of said backerboard panel of the rearward face of said siding panel are in abutting relationship attaching said siding panel and said backerboard panel to a building surface, engaging the bottom flange of second siding panel with the longitudinal interlock member on the upper margin of said first siding panel, and inserting a second beveled edge backerboard panel behind said second siding panel so that said lower beveled edge of said second backer panel slides over said top beveled edge of each first backer panel into a backing relationship position with the rearward face of said second panel, attaching said second siding panel and second backer panel to the surface of said building, and repeating each of the above steps for successive courses of paneling.

6. The method of claim 5 wherein said backerboard panel is inserted in an offset manner as it is being moved into backing relationship with the rearward face of said second panel a lateral force is simultaneously applied to move said panel into its proper orientation.

7. In combination, at least two elongated siding panels extending in horizontal courses, being a lower panel and an upper panel, each said siding panel having a longitudinally extending rearwardly disposed flange on the lower edge thereof and a longitudinally extending interlock member on the upper edge thereof adapted for interlocking the rearward flange of said upper panel with the interlock member of said lower panel, a lower backerboard element in abutting relationship to the rearward surface of said lower panel, and an upper backerboard element in abutting relationship to the rearward surface of said upper panel, said upper backerboard element having forward and rearward surfaces and top and bottom edges, wherein the improvement comprises said top and bottom edges of said upper backerboard element being beveled downwardly from said rearward surface to said forward surface to induce said bottom edge of said upper backerboard element sliding downwardly over said lower backerboard element into said flange of said upper panel.

8. The combination of claim 7 wherein a plurality of siding panels are mounted in courses on a substrate in interlocking relation with the lowermost panel member of said plurality interlocking with said upper panel, and a corresponding number of backerboard elements, each said backerboard element in abutting relationship to the rearward surface of said respective siding panel, each said backerboard element having forward and rearward surfaces and top and bottom edges, said top and bottom edges being beveled downwardly from said rearward surface to said forward surface to induce said bottom edge of a next upper adjacent backerboard element sliding downwardly over the upper edge of the lower adjacent backerboard element into said flange of said respective siding panel.

9. The combination of claim 8 where each said backerboard element is in substantially contacting relationship along said forward surface with said respective siding panel to provide uniform support for said respective siding panel.

* * * * *